United States Patent [19]

Bouché

[11] Patent Number: 4,534,482

[45] Date of Patent: Aug. 13, 1985

[54] STOPPERING DEVICE FOR BOTTLES

[76] Inventor: Michel Bouché, Les Salomons, 63300 Thiers, France

[21] Appl. No.: 613,147

[22] Filed: May 23, 1984

[51] Int. Cl.[3] ..... B65D 45/30
[52] U.S. Cl. ..... 215/272
[58] Field of Search ..... 215/272; 220/315, 319, 220/320

[56] References Cited

U.S. PATENT DOCUMENTS

| | | | |
|---|---|---|---|
| 2,949,205 | 8/1960 | Fitz | 215/272 |
| 3,297,187 | 1/1967 | Thiesen | 215/272 |
| 3,680,731 | 8/1972 | Lelyk et al. | 220/319 |
| 3,905,502 | 9/1975 | Wassilieff | 215/272 |

FOREIGN PATENT DOCUMENTS 2476608 8/1981 France .

*Primary Examiner*—Donald F. Norton
*Attorney, Agent, or Firm*—Michael Ebert

[57] ABSTRACT

A stoppering device for a bottle having a neck provided with a protruding rim surrounding a mouth, the device being intended for the restoppering of bottles containing champagne or other gaseous beverages. The device includes a cylindrical inner part whose lower section is slotted to define a multilobed skirt, each lobe of which terminates in an inner tooth adapted to engage the bottle neck below the rim and to apply a sealing member onto the mouth. Also included is a cylindrical outer part forming a locking member adapted to surround the skirt so as to engage the teeth of the skirt below the rim and to hold these teeth at that position.

7 Claims, 5 Drawing Figures

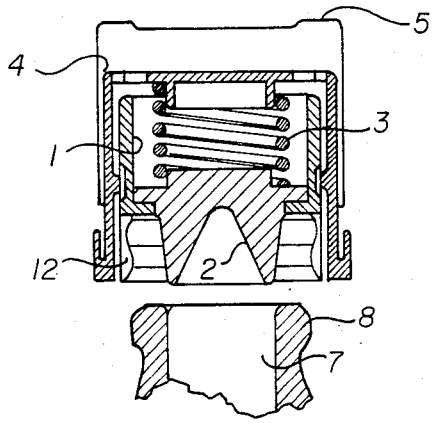
FIG.2
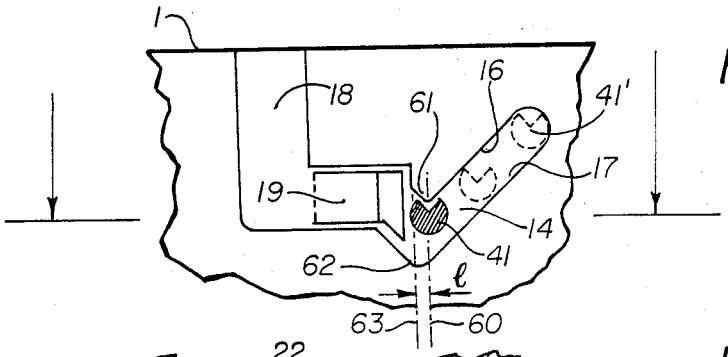
FIG.3a
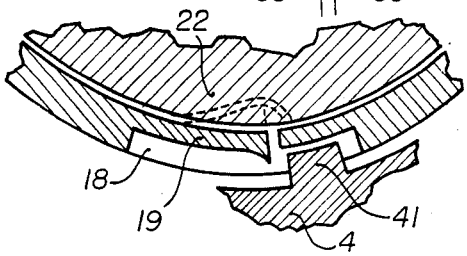
FIG.3b
FIG.4
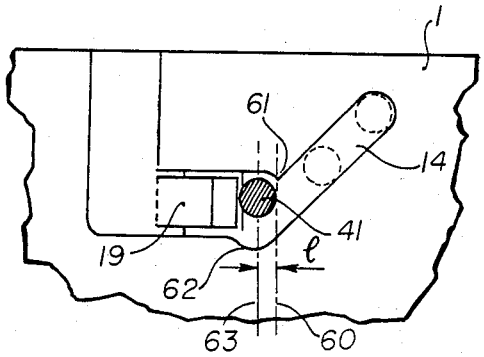

STOPPERING DEVICE FOR BOTTLES

BACKGROUND OF INVENTION

Field of Invention

The present invention relates generally to the stoppering of receptacles which have a neck, and in particular to a stoppering device intended for the restoppering of bottles containing gaseous beverages such as champagne.

A stoppering device constituting prior art for the present invention is described in U.S. Pat. No. 3,779,412. However, the present invention is more specifically related to applicant's prior French Pat. No. 2,476,608. The device described in this French patent incorporates a cylindrical inner part whose lower slotted section takes the form of a multilobe skirt. Each lobe has, at its extremity, an inner tooth adapted to engage the neck of the bottle below the rim surrounding the mouth and to apply a sealing member onto the mouth.

This prior device further comprises a cylindrical outer part constituting a locking member adapted to surround the skirt of the inner part and to slide along it in order to engage the teeth below the rim and maintain them at that position. The movement of the outer part with respect to the inner part is a helicoidal movement from an upper to a lower position known as the locking position. This movement is guided by means of a pair of ramps formed by recesses on the outer face of the inner part, and a pair of tenons which protrude from the inner face of the outer part.

Each tenon is adapted to travel on its corresponding ramp between a locking position and an unlocking position, each of these positions representing a stable position of the tenon on its ramp. It is to be understood that the expressions "top" and "bottom" are used with respect to the vertical position normally assumed by a receptacle.

In one of the embodiments of the device described in the above-identified French patent, the ramps have an asymmetrical U or V shape, the shorter arm of which defines the locking position, while the longer or higher arm defines the unlocking position of the lobes of the skirt. The width of the ramp is substantially constant and equal to the diameter of the tenons which are of circular shape.

In practice, it has been found that such prior art stoppering devices sometimes suffer from the drawback that they cannot be removed after having been placed in position on a bottle neck. This drawback appears to be due to the fact that in order to pass from one arm of the ramp to the other and, in particular, from the bottom arm to the top arm or from the closed position to the open position, it is necessary to cause the tenons to pass through a transition portion of the ramp along which rotary movement of the outer part with respect to the inner part is permitted only in the event that the inner part is more firmly connected to the neck than the outer part is to the inner part. This is true when the mouth of the neck is dry, but it is no longer true when the mouth of the neck is wetted by the liquid contained within the bottle. The same drawback can, of course, be experienced when restoppering while the neck is wet. As a consequence, it is not possible to lock the stopper on the neck.

SUMMARY OF INVENTION

The main object of this invention is to obviate the above-described drawback by providing special shapes for the ramps and/or the tenons of the stoppering device.

Another object of the invention is to provide more convenient and effective means for arranging and mounting the constituent parts of the device.

In accordance with the present invention, the stoppering device is first characterized by the fact that the lower wall of each ramp is extended beyond a generatrix which passes through the lowest point of the upper ramp wall by a distance 1 sufficient to permit the tenon, upon rising along a generatrix, to come into and occupy a housing located beyond the lowest point of the upper ramp wall.

The invention is secondly characterized by the fact that it has a tenon-insertion channel which is of L shape and emerges on one end at the upper edge of the inner part and emerges on the other end in the housing for the tenon. The lower portion of the insertion channel has a pawl therein which can move away upon the passage of the tenon when the latter, upon mounting of the stopper, passes from the channel into its housing, and which, after the passage, prevents the return of the tenon into the channel. The ramps and the channels preferably take up only a fraction of the thickness of the inner part in which they are recessed.

The invention is thirdly characterized by the fact that the inner part has an annular shoulder above the skirt, and the sealing member is constituted by a plug of plastic material which is recessed at its bottom portion and includes a peripheral rim adapted to rest on the annular shoulder of the inner part, its upper portion forming a stud intended for the centering of a spring. The annular shoulder is preferably located just below the pawl so that the peripheral rim is opposite the pawl and constitutes a means for moving it back.

OUTLINE OF DRAWINGS

The present invention will be better understood and other features of its will become evident from the detailed description given below of a particular embodiment, read with reference to the accompanying drawings, in which:

FIG. 2 is a section view thereof showing the assembled device;

Figure 1:
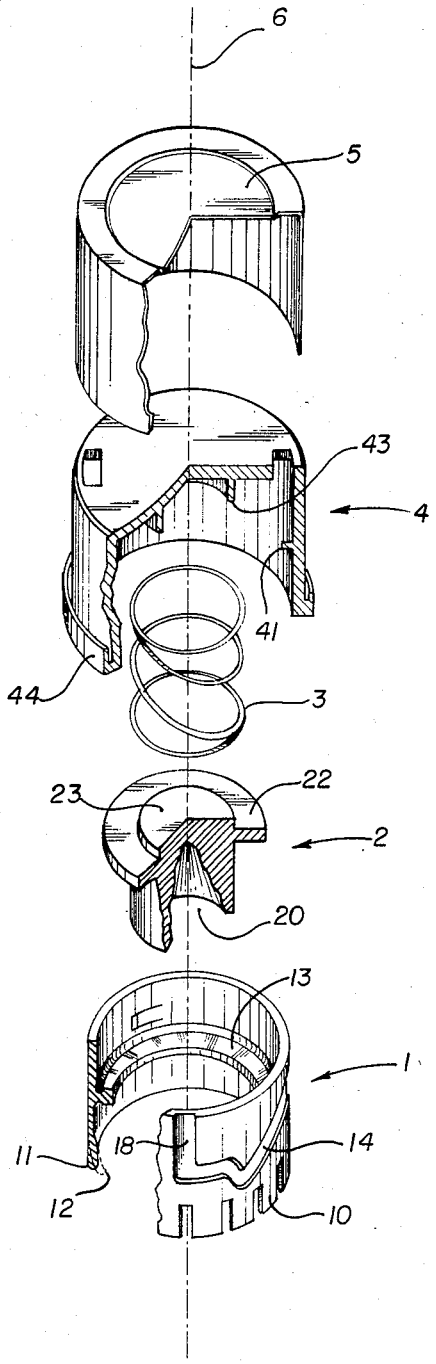
FIG. 1 is an exploded perspective view, partially in section, of a stoppering device in accordance with the invention.

FIGS. 3*a* and 3*b* show, on a larger scale, a construction detail of the device shown in the previous figures; and FIG. 4 shows a variant embodiment of the detail of the preceding figure.

DESCRIPTION OF INVENTION

In FIG. 1, a stoppering device in accordance with the invention comprises an inner part 1 of generally cylindrical tubular shape, a sealing member 2, a spring 3, an outer cylindrical part 4 closed at its top, and a cap 5, preferably of metal, adapted to fit over part 4. These parts, when they are assembled, have a common axis of symmetry 6.

The lower section of tubular part 1 is slotted to define a multilobe skirt 10, each lobe, such as 11, being provided at its lower extremity with a bulging inner tooth 12. Inner part 1 is provided on its inner face with an annular shoulder 13, and on its outer face with a pair of recessed ramps, such as the ramp 14 which is inclined with respect to the axis 6. The other ramp which spaced by the distance $\pi/2$ around the axis 6 from ramp 14, is not visible in the figure, but is entirely symmetrical to ramp 14. The special shape of these ramps will be described further below in connection with the detailed illustrations.

Sealing member 2 is a plug of elastomeric material having a conical recess 20 within its bottom portion, and a peripheral rim 22 adjacent its top. The top of the plug is shaped as a stud 23 adapted to receive and center the helical spring 3.

Outer part 4 is provided on its inner face with two diametrically-opposite tenons, such as 41, as well as with a spring-centering stud 43 similar to plug stud 23. An outer rim 44 having an annular groove on the base of outer part 4 makes it possible to house the lower edge of the cap 5 within the groove.

In FIG. 2, the parts illustrated in FIG. 1 are shown assembled (except that the lower edge of cap 5 has not yet entered the groove in the rim of the outer part 4 so as to make the drawing more easily readable). The assembly is placed above a bottle neck 7 which at its upper portion has a protruding rim 8 below which the teeth 12 of the lobes are intended to engage when the sealing member 2 is pushed inside of neck 7. It is to be noted that the compressed spring 3 exerts a continuous force in the direction of disengagement of the inner and outer parts 1 and 4.

For the sake of clarity, in FIG. 2 the stopper has not been shown engaged on neck 7 of the bottle as would actually be the case, inasmuch as the parts of the stopper are shown in locking position (the outer part surrounding the lobes of the skirt). Hence, the arrangement as shown in FIG. 2 is not found in actual fact.

From FIGS. 3*a* and 3*b* it can be seen that ramp 14 recessed in the body of inner part 1 is defined by an upper wall 16 and a lower wall 17 and has a V shape. One of the arms of ramp 14 reaches the upper edge of the inner part 1 via a channel 18 of L shape which is intended to permit the initial insertion of the tenon 41 into the ramp. The lower portion of the insertion channel 18 has a pawl 19 which can move away upon passage of the tenon 41 when the latter, upon the mounting of the stopper, passes from channel 18 to the ramp 14, the pawl preventing the return of the tenon into the channel. Tue return of pawl 19, after it is moved away, is facilitated by the pressure which is exerted on it by the peripheral rim 22, as can be clearly noted in the sectional view of FIG. 3*b*.

Referring still to FIG. 3*a*, it will be seen that tenon 41 occupies a so-called locking position corresponding to the arrangement of the parts in FIG. 2 while, in the dashed line position 41', it occupies a so-called unlocking position.

It will be noted that lower wall 17 of ramp 14 extends beyond a first generatrix 60 which passes through the lowest point or ridge 61 of upper wall 16, down to a bottom point 62 located on a second generatrix 63. The distance 1 between the generatrices 60 and 63 is sufficient so that tenon, when rising under the force of spring 3 along the second generatrix 63, can house itself within a housing located beyond the lowest point of the upper ramp wall. This housing is defined by the ridge 61 and the edge of the pawl 19.

The distance between the bottom points 61 and 62 of the upper and lower walls of the ramp provides the tenon with a play along a generatrix. This play, under the action of a manual screwing or unscrewing movement, enables it to pass from one side to the other of the generatrix 60 which separates the locking positon from the unlocking position.

In the embodiment shown in FIG. 3*a*, the tenon is provided with a notch within which is engageable by ridge 61. This arrangement has the advantage of preventing wear of ridge 61 and of better defining the stable locking position.

In FIG. 4, there is shown a second embodiment of the shape of the ramps and tenons, in which the tenons have a cylindrical shape. It will be noted that the generatrices 60 and 63 which pass through the lower ramp points 61 and 62, respectively, are slightly further apart than in the preceding example.

Both in the embodiment of FIGS. 3*a* and that of FIG. 4, the operation of the stopper is as follows: When, with the lower face of the annular shoulder 13 resting against the upper end of a neck 7, one pushes strongly on cap 5, the tenons 41 then come to bear in sliding fashion on the lower walls 17 of ramps 14 and to impart to the latter a turning movement which continues until the tenons 41 have reached the lowest point 62 of their respective ramps. They have then gone beyond the generatrix 60 corresponding to the ridge 61, and relaxation of pressure on cap 5 permits them to rise along the generatrix 63 and to house themselves beyond ridge 61. Upon the reapplication of pressure onto cap 5, together with a slight movement of rotation in the opening direction, the tenons will, on the other side of ridge 61, be again placed in sliding contact with upper wall 16 of ramps 14. The sliding contact will continue until the tenons come into the stable open position 41'.

Although preferred embodiments have been described and shown, it is to be understood that the present invention is noted limited thereto but that it comprises a stoppering device of the aforementioned type having the general characteristics set forth above.

I claim:

1. A stoppering device for a bottle whose neck has a protruding lip which surrounds the mouth thereof, the device comprising:

A. a sealing member receivable in the mouth of the bottle;

B. a cylindrical inner part having a lower section slotted to define a multilobe skirt, each lobe of which terminates in an inner tooth, said inner part being adapted to engage the neck of the bottle and to apply said sealing member onto the mouth thereof;

C. a cylindrical outer part forming a locking member adapted to surround the skirt and the slide along the inner part so as to place the teeth of the skirt below the rim of the bottle and hold the teeth at that position;

D. a pair of ramps recessed in the outer surface of the inner part, each ramp being defined by an upper wall and a lower wall; and E. a pair of tenons protruding from the outer part, each tenon being adapted to travel in a respective ramp between a locking and an unlocking position, further characterized by the fact that the lower wall of each ramp is extended beyond a first generatrix on the inner part which passes through the lowest point on the upper wall of the ramp by a distance which is sufficient to permit the tenon, upon rising along a second generatrix to reach and occupy a housing located beyond the lowest point of the upper ramp wall.

2. A device as set forth in claim 1, further including on the inner part a tenon-insertion channel having an L-shape which at one end emerges at the upper edge of the inner part and at the other end emerges in the housing for the tenon, said channel having a pawl therein which is displaced by the tenon as it passes from the channel to the tenon housing.

3. A device as set forth in claim 2, in which the inner part has an annular shoulder on its inner face above the skirt, the sealing member being formed by a plastic plug having a hollow base and a peripheral rim which rests against said shoulder.

4. A device as set forth in claim 3, wherein said plug has a stud formed on its top on which is mounted a spiral spring which is compressed between the inner and outer parts to urge the outer part away from the inner part.

5. A device as set forth in claim 4, wherein said annular shoulder is located below said pawl whereby the peripheral rim of the plug is opposite to the pawl and functions as a means for the return thereof.

6. A device as set forth in claim 5, wherein said ramps and channels are recessed in the body of the inner part to an extent which takes up only a fraction of its thickness.

7. A device as set forth in claim 6, wherein each tenon is provided with a notch, and the lowest point of the upper wall of the ramp has a ridge form to engage the notch.

* * * * *